US006408613B1

(12) United States Patent
Shaw

(10) Patent No.: US 6,408,613 B1
(45) Date of Patent: Jun. 25, 2002

(54) HIGH TEMPERATURE, HIGH PRESSURE VAPORIZER TO POWER A MULTI-CYLINDER EXPANSION ENGINE

(76) Inventor: John B. Shaw, 1812 E. Marlette Ave., Phoenix, AZ (US) 85016

( * ) Notice: Subject to any disclaimer, the term of this patent is extended or adjusted under 35 U.S.C. 154(b) by 0 days.

(21) Appl. No.: 09/839,627

(22) Filed: Apr. 20, 2001

(51) Int. Cl.[7] ..... F02C 5/00
(52) U.S. Cl. ..... 60/39.6; 126/91 A; 431/278
(58) Field of Search ..... 60/39.6; 126/91 A; 431/157, 158, 278, 284, 285, 215, 353

(56) References Cited

U.S. PATENT DOCUMENTS 3,890,088 A * 6/1975 Ferri ..... 431/351
5,368,474 A * 11/1994 Welden ..... 431/278 X
5,426,940 A * 6/1995 Tomoiu ..... 60/39.6 X

FOREIGN PATENT DOCUMENTS

| | | | | |
|---|---|---|---|---|
| AT | 221206 | * | 5/1962 | ..... 126/91 |
| JP | 405039908 | * | 2/1993 | ..... 126/91 |
| JP | 405039909 | * | 2/1993 | ..... 126/91 |

* cited by examiner

*Primary Examiner*—Hoang Nguyen
(74) *Attorney, Agent, or Firm*—Frank J. McGue

(57) ABSTRACT

A high-pressure computer controlled chamber, processing high-temperature combustion gases combining with a vaporizing liquid, to create a high-energy flow to an expansion engine to do variable-rate work.

4 Claims, 2 Drawing Sheets

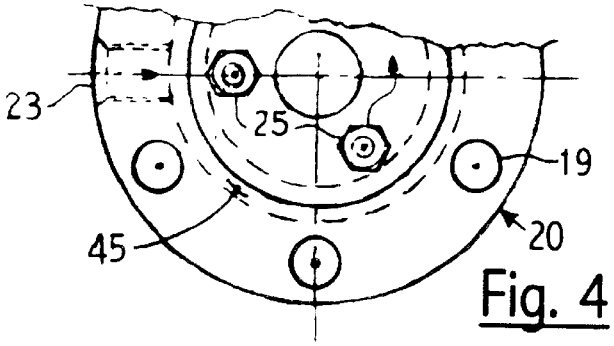
Fig. 4
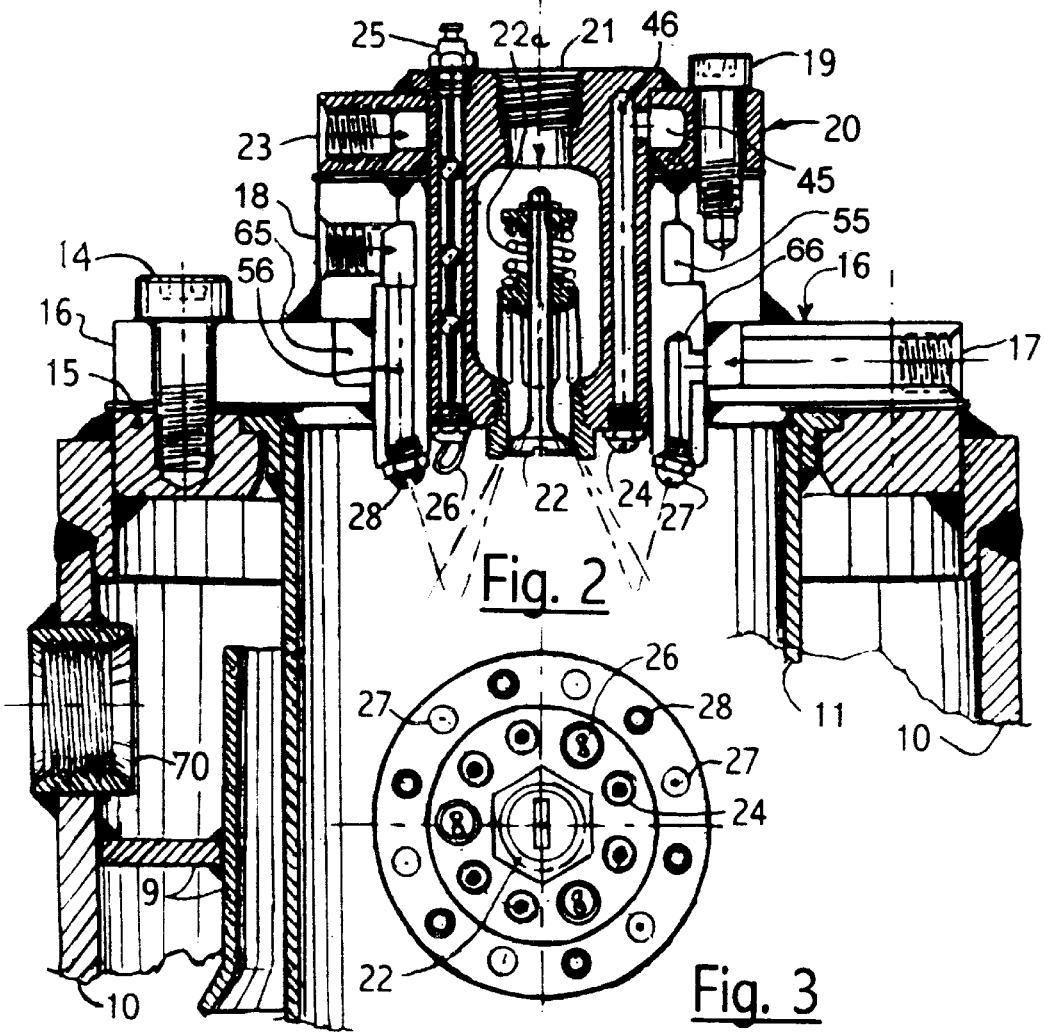
Fig. 2
Fig. 3

HIGH TEMPERATURE, HIGH PRESSURE VAPORIZER TO POWER A MULTI-CYLINDER EXPANSION ENGINE

TECHNICAL FIELD

This invention relates in general to self-powered vehicles and more particularly to non-electric commuter rail cars, regional rapid transit cars, long distance inter-city passenger and express mail trains.

BACKGROUND OF THE INVENTION

The majority of the non-electric powered transit systems of the world use the internal combustion Diesel engine to provide the motive force to propel the driving wheels of the vehicle for travel in either direction.

In modern inter-city and regional light rail passenger coaches, the Diesel engine is attached to a transmission housing containing a hydraulic torque amplifier, a set of reversible reduction gears, and a hydraulic retarder. This combination drives the wheels through axle mounted final reduction gears.

These engines and their drive systems are heavy, costly, and require frequent and expensive maintenance procedures. Their exhaust gases also contribute to atmospheric contamination.

Thus there is a need for a multiple-cylinder reciprocating vapor-expansion engine that can develop its maximum torque at rotational start up and whose work-power output per pound of weight is greater by using an external-combustion source of high pressure vapor energy. Such an engine is disclosed in applicant's co-pending application Ser. No. 09/757,974.

Furthermore, there is a need for an engine and vaporizer combination that has a computer system that integrates all variable operating conditions to digitally actuate the valves and the vaporizer combustion modulation for the most efficient fuel consumption and maximum power output.

Lastly, there is a need for an engine-vaporizer-computer combination that is reversible and performs equally well in either clockwise or counter-clockwise rotation and that can direct-drive the traction wheels of the vehicle.

None of the known prior art disclose such an engine-vaporizer-computer combination as set forth herein.

The present invention as delineated meets these needs.

OBJECT OF THE INVENTION

This invention provides the combination of basic devices that are utilized to produce a high pressure, high temperature flow of a gas/vapor energy stream to an expansion engine for the production of rotating shaft work.

It is an object of this invention to provide an efficient combination of the products of fuel combustion and water vaporization to develop a high-energy stream flow to an expansion engine driving a transport vehicle without creating significant environmental pollution.

It is a further object of this invention to utilize a digital computer to integrate all variables of pressure, temperature and volume by the many recording, analyzing instruments and control devices needed to regulate the energy required for the most efficient operation of the total combined mechanism.

It is also a further object of this invention to construct the total mechanism with easily replaceable standardized elements that are subject to attrition and wear without requiring a major back-shop hiatus.

SUMMARY OF THE INVENTION

This invention advances the practice of obtaining from a minimum of heat energy the most work output with the least atmospheric pollution by storing and transporting of fuel gas, hydrogen and oxygen gasses at very high pressures. The gasses are individually and controllably metered for injection into the high pressure combustion chamber. The metering of the pressurized water into the flame vortex vaporizes and desuperheats the combined gasses sent to the engine. Thus the water reduces the combined vapor temperature to the optimum consistent within the limits of its containment, transmission to, and the safe operation of the expansion engine. By the elimination of compressed air in this device, the nitrogen contaminants and particulates are eliminated.

The production of the gasses in large quantities in stationary plants operating continuously, stores large quantities of potential energy for periodic disbursment to the traveling vehicles at the beginning of their daily assignment, which puts the major investments and equipment weights in their appropriate areas of usefulness.

BRIEF DESCRIPTION OF THE DRAWINGS

The present invention may be more readily described by reference to the accompanying drawings in which:

FIG. 2 shows a sectional view of the chamber flange mounting of the fuel jet header (not cross-hatched) and the water-jet nozzle (cross-hatched).

FIG. 3 is a bottom view of the fuel spray nipples, the ignition tips and the spring-closed water spray valve.

FIG. 4 is a top view of the water jet nozzle assembly.

DESCRIPTION OF A PREFERRED EMBODIMENT

Figure 1:
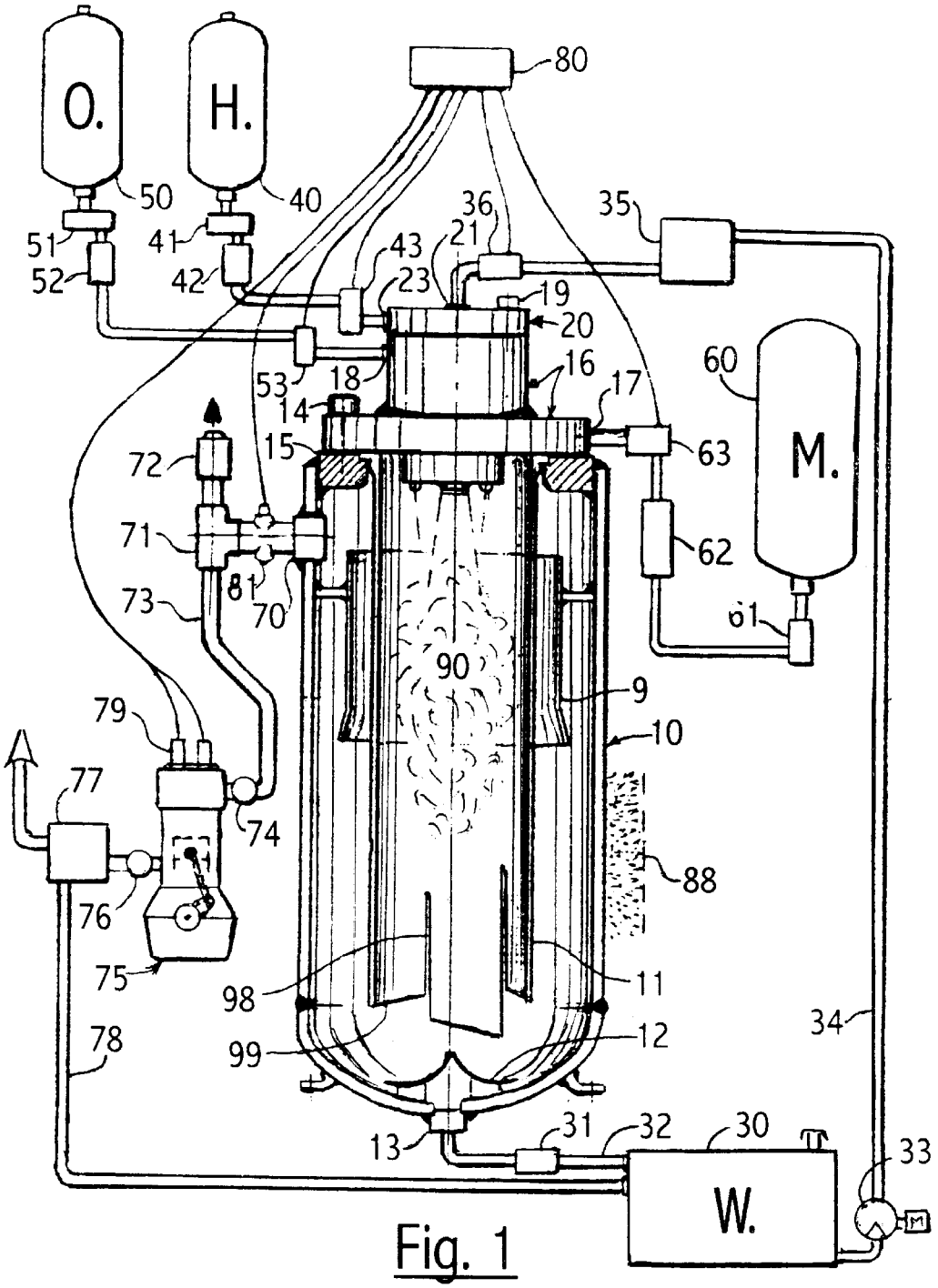
FIG. 1 shows a sectional view of the combustion chamber, and the surrounding components needed for the operation of the total system.

Referring to the drawings, FIG. 1 illustrates a combination of the many major components required to energize an expansion engine 75, and FIG. 2 illustrates the internal construction and fabrication details. The heavy wall high pressure combustion chamber 10 contains an open end vaporization cylinder 11, a flow reversing deflector cone 12 and a condensate drain 13. A chamber top flange 15 using twelve capscrews 14 anchors a fuel-jet header 16, which clamps a removable vaporization cylinder 11 down. A replaceable water jet nozzle 20 is mounted on the header 16 by six capscrews 19.

A main water tank 30 is refilled by condensate water occurring in the combustion chamber 10 during a cold start. Water is released by a trap valve 31 into a pipe 32 to return to tank 30. Engine 75 exhausts into condenser 77 which captures water that is then released into a pipe 78 to return to tank 30.

Water tank 30 normally holds its contents at atmospheric pressure until withdrawn by a variable speed, pressure regulated pump 33 forcing water up in a pipe 34 into a heated variable volume accumulator tank 35. A metering valve 36 responding to commands from a computer 80, forces water into a nozzle inlet port cavity 21, and is released by overcoming a spring-closed spray valve 22 for injection and vaporization in a flame vortex creating a gas/vapor energy stream 90.

A pressurized tank of hydrogen gas 40 is released by a pressure reducing valve 41 to maintain a constant pressure in a pre-heater tank 42 and a metering valve 43, responding to commands from a computer 80, releases hydrogen gas into an inlet port 23 which is distributed internally by channels 45, 46 to the multiple-injection nipples 24 and igniters 26 for flame propagation.

A pressurized tank of oxygen gas 50 is released by a pressure reducing valve 51 to maintain a constant pressure in a pre-heater tank 52 and a metering valve 53, responding to commands from computer 80, releases oxygen gas into an inlet port 18 which is distributed internally by channels 55, 56 to the multiple-injection nipples 28 and igniters 26 for flame propagation.

A pressurized tank of fuel gas (such as methane) 60 is released by a pressure reducing valve 61 to maintain a constant pressure in a pre-heater tank 62 and a metering valve 63, responding to commands from computer 80, releases fuel gas into an inlet port 17 which is distributed internally by channels 65, 66 to the multiple-injection nipples 27 and igniters 26 for flame combustion and water vaporization, creating an energy stream 90 of superheated gas/vapor. Computer 80, in response to the commands of a train master controller (not shown) and a plurality of indicating-recording instruments on the many devices needed to efficiently manage the total system determines the pressure, temperature and volume. Instrument probe 81 in the combustion chamber outlet port 70 to a supply tube 73 manifold pipe 71 records the temperature and pressure of the energy flowing to the expansion engine 75.

The combined gas/vapor stream 90 rockets down vaporizer tube 11 to be turned by the deflecting cone 12, to rush upward through a constricting collar 9 before exiting chamber 10 at port 70. Constricting collar 9 forces the gas/vapor stream 90 to closely extract the excess heat from the exterior of vaporization tube 11, where it receives the inner radiant heat of the combustion flame. Outlet port 70 and manifold tube 71 mount an over-pressure safety valve 72 for emergency release of excess-pressure to atmosphere above the vehicle. Supply tube 73 transports energy stream 90 thru an intake manifold 74 into engine 75 where it develops the required motive power to propel the train (not shown). The expanded low-pressure vapor is released through exhaust manifold 76 to a condenser 77 then exhausted to atmosphere above the vehicle, and the captured water condensate is returned by pipe 78 to water tank 30 for reuse.

Referring now to FIG. 2 which shows the construction of top flange 15 of combustion chamber 10 closed by fabricated fuel-jet hub 16 (that is not crosshatched), having injection nipples 27&28, circular internal gas distribution galleries 55&65, and vertical nipple feeder tubes 56&66, which are all machine-cut separately, then arc-welded to create finished fuel-jet hub 16.

A water-jet nozzle 20 (crosshatched) mounted on hub 16, is fabricated of stainless steel, machine cut and welded to contain a water inlet cavity 21 that secures the spring closed injection spray valve 22. Three threaded holes for electrical ignition glow plug tips 26 terminals 25, and a circular gallery 45 and vertical tubes 46 are thereby fabricated for hydrogen gas distribution to injection nipples 24.

The pressurized water is injected into intake port cavity 21 by computer controlled metering valve 36 to a spring-closed spray valve 22, whose function is to prevent under-pressurized water from entering the vaporizer tube 11 when no combustion is in process. The closing spring 22*a*, is calibrated to open and maintain a pressure-sensitive volume ratio of water to obtain the desired maximum amount of heat to the gas/vapor stream 90 flowing to the expansion engine 75 for economical conversion into work-energy.

The vaporization tube 11 if fabricated of hard-drawn copper with its inner surface amalgamated with a polished layer of metallic nickel to reflect the maximum radiant heat and absorption of the combustion flame. The top end has a retaining rim that is clamped by fuel-jet hub 16 into chamber top flange 15. The low end has variable length slits 98 and variable length sloping ends 99 to eliminate resonating vibrations.

Standard heavy duty industrial heat-retaining insulation 88 (not shown) is used to cover most components, pipes and tanks to conserve the maximum of stored heat energy.

Purpose of this Total System

To achieve the maximum work-energy output, with the minimum of heat loss by combining the combustion flame with the vaporizing fluid within a pressurized chamber, thus sending the total heat-energy to the expansion engine. The standard industrial practice of doing essentially atmospheric combustion on the exterior of the vessel containing the vaporizing fluid, then sending the considerable residual heated combustion gasses to the 'smoke-stack' for dissipation in the atmosphere. This lost fuel energy is not available for the most efficient cycle of heat into work.

Although but one embodiment of the invention has been shown and described, It will be obvious to those skilled in this art, that various changes and modifications may be made therein without departing from the spirit of the invention and the scope of the appended claims.

What is claimed is:

1. A vaporizer for use with a multi-cylinder expansion engine, comprising a heavy walled high pressure heavily insulated combustion chamber closed at its top flange by a fuel jet header mounting a water-jet nozzle with fuel igniters, the header clamping a replaceable open ended vaporization cylinder that confines and directs an internal combustion flame creating vaporized gasses flowing downwardly in the vaporization cylinder until a deflector-cone, mounted on the bottom of the combustion chamber, below the lower end of the vaporizer tube, redirects the gasses upwardly between the exterior of the vaporization cylinder and the interior of the combustion chamber through a barrier supported constricting collar, the constricting collar extracting excess heat from the exterior of the vaporization cylinder adjacent to the interior flame area, the gasses exiting near the top of the combustion chamber to flow to said expansion engine to do useable shaft-work.

2. The chamber as set forth in claim 1, wherein the vaporization cylinder has partial vertical slits, and variable length lower ends, to eliminate resonant physical and audible vibrations.

3. A vaporizer for use with a multi-cylinder expansion engine, comprising a heavy walled high pressure combustion chamber closed at its top flange by a fuel jet header, containing a replaceable water-jet nozzle, clamping a separable top-flanged open ended vaporization cylinder that confines and directs a combustion flame creating vaporized gasses flowing downwardly in the vaporization cylinder until a deflector-cone, mounted on the bottom of the combustion chamber, below the lower end of the vaporizer tube, redirects the gasses upwardly between the exterior of the vaporization cylinder and the interior of the combustion chamber, the gasses exiting near the top of the combustion chamber, then to flow to said expansion engine to do useable shaft-work,the vaporizer further comprising pressurized fuel, oxygen and hydrogen tanks, and a water tank supplying a pressurizing pump, each flow circuit having intermediate pressure maintaining valves supplying the intake metering valves which are controlled by an integrating digital computer for efficient combustion and vaporization when combined with the operation of said expansion engine.

4. The chamber as set forth in claim 1 wherein the fuel-jet header and the water-jet nozzle, each having multiple vertical passages formed into a circular gallery providing gaseous communication to a plurality of injection nipples, each gallery having a single intake port for a specific pressurized gas, the water jet nozzle further having three threaded holes for ignition glow plug tips.

* * * * *